United States Patent [19]

True

[11] Patent Number: 4,739,629

[45] Date of Patent: Apr. 26, 1988

[54] WATER STORAGE TANK FOR USE IN THE FRESH FOOD COMPARTMENT OF A REFRIGERATOR

[75] Inventor: Howard D. F. True, Bloomington, Ind.

[73] Assignee: General Electric Company, Louisville, Ky.

[21] Appl. No.: 27,312

[22] Filed: Mar. 18, 1987

[51] Int. Cl.[4] ..... F25D 23/12

[52] U.S. Cl. ..... 62/338; 62/389; 165/81

[58] Field of Search ..... 62/338, 339, 389; 222/146.6; 248/201, 221.4, 675; 165/67, 81

[56] References Cited

U.S. PATENT DOCUMENTS

| | | | |
|---|---|---|---|
| 1,557,200 | 10/1925 | Hull | 62/339 |
| 1,892,197 | 12/1932 | Zerwer | 165/81 |
| 2,045,009 | 6/1936 | Ehle | 62/338 X |
| 2,982,114 | 5/1961 | Cobb et al. | 62/389 X |
| 3,205,678 | 9/1965 | Stoner | 62/457 |
| 3,406,532 | 10/1968 | Rownd et al. | 62/457 |
| 3,511,415 | 5/1970 | Crowe | 62/339 X |
| 3,570,266 | 3/1971 | Alvarez et al. | 62/389 X |
| 3,834,178 | 9/1974 | Pink | 62/389 X |
| 4,036,620 | 7/1977 | Benasutti et al. | 62/338 |
| 4,223,043 | 9/1980 | Johnson | 426/122 |
| 4,306,615 | 12/1981 | Bolton et al. | 165/67 |

*Primary Examiner*—William E. Tapolcai
*Attorney, Agent, or Firm*—Frederick P. Weidner; Radford M. Reams

[57] ABSTRACT

A water storage tank for use in the fresh food compartment of a refrigerator comprising a surpentine shaped hollow body having parallel first, second, third and fourth straight sections serially connected. The first section has an inlet at the top end and the fourth section has an outlet at the top end. The first section is connected to the second section by a U-shaped curved section at the bottom end, the second and third sections are connected at the top by a U-shaped curved section, the third and fourth sections are connected at the bottom by a U-shaped curved section, with all of the U-shaped curved sections having an internal curvature in the shape of a teardrop. The four straight sections of the serpentine shaped hollow body are connected at the top thereof by air flow passageways.

5 Claims, 4 Drawing Sheets

WATER STORAGE TANK FOR USE IN THE FRESH FOOD COMPARTMENT OF A REFRIGERATOR

BACKGROUND OF THE INVENTION

This invention relates to a water storage tank for use in the fresh food compartment of a refrigerator such as a refrigerator that is adapted to dispense cold water.

Household refrigerators have been adapted to store water in the fresh food compartment so that it may be cooled and dispensed by the user actuating a water pressure valve to introduce the cold water into a drinking container. Many such refrigerator models are side-by-side refrigerators wherein the freezer compartment is on one side of the refrigerator and the fresh food compartment is on the other side of the refrigerator with an insulating partition between the compartments. In this type of refrigerator the water is dispensed by a through-the-door compartment where the user presses a drinking container or glass against an actuator which releases the drinking water into the glass without the need for opening the refrigerator. In some models the dispensing may take place inside the refrigerator and in either case the object is to supply cold water to the user. Heretofore it has been customary to install a container or storage tank usually made of plastic inside the fresh food compartment at the rear and near the bottom of the fresh food compartment. In many cases it is behind the vegetable pan drawers and the meat pan drawer. In the design of such refrigerators the meat pan is located at the bottom section of the refrigerator so that it will be subjected to a lower temperature than the rest of the fresh food compartment and in many cases the cold air being supplied to the fresh food compartment is directed downwardly toward the meat pan to help keep it at a lower temperature. One difficulty with such an arrangement is that the cold air impinges upon the water storage tank and since the cold air may be slighly below freezing temperature when it enters the fresh food compartment the water in the storage tank can freeze and thereby cause the storage tank to rupture or burst.

By this invention there is provided a water storage tank for use in the fresh food compartment of a refrigerator which will not rupture in the event the water in the container becomes frozen.

DESCRIPTION OF THE PREFERRED EMBODIMENT

Figure 1:
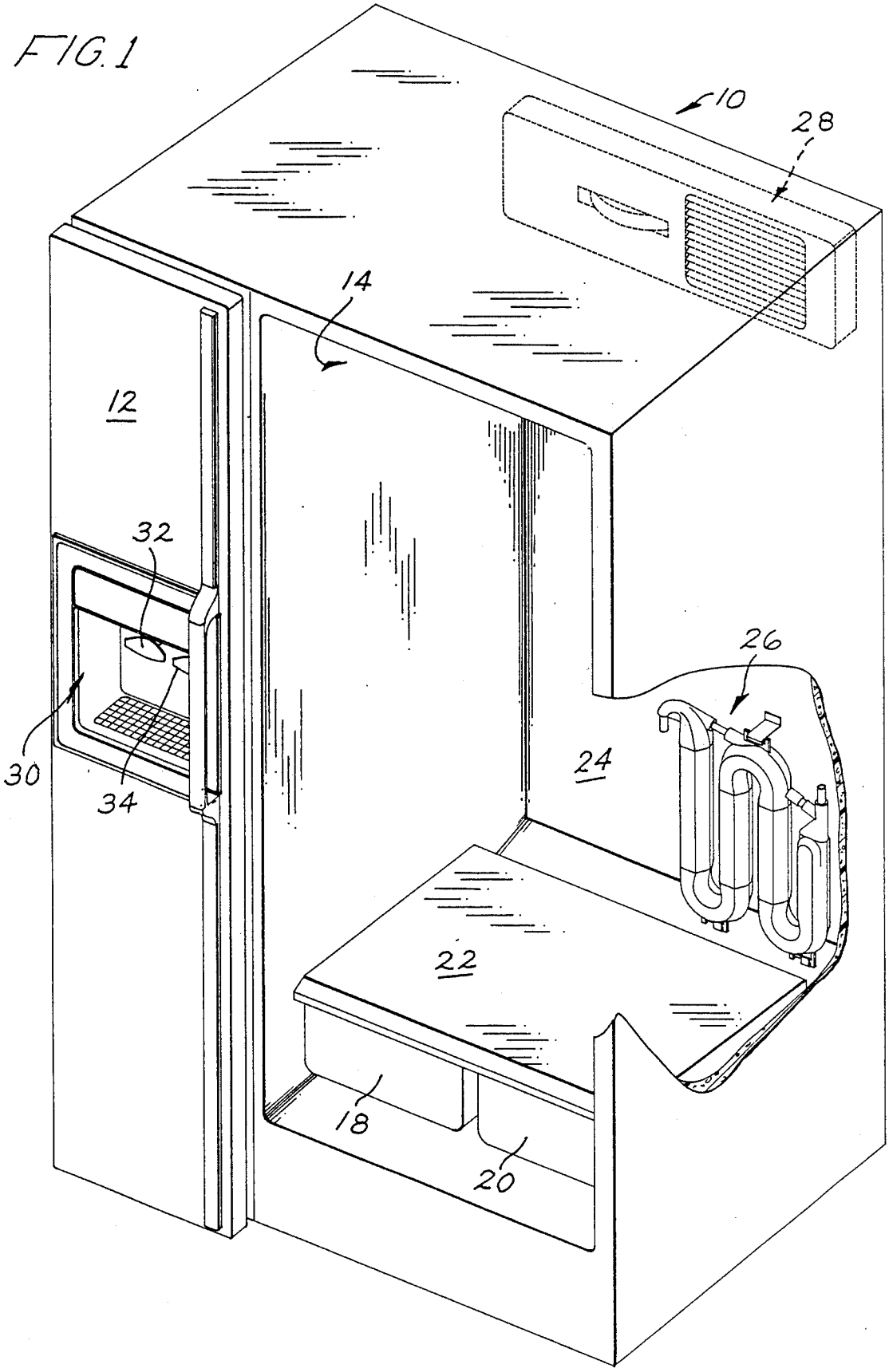
FIG. 1 is a perspective view of a side-by-side refrigerator with parts broken away showing the present invention incorporated therein.
Figure 2:
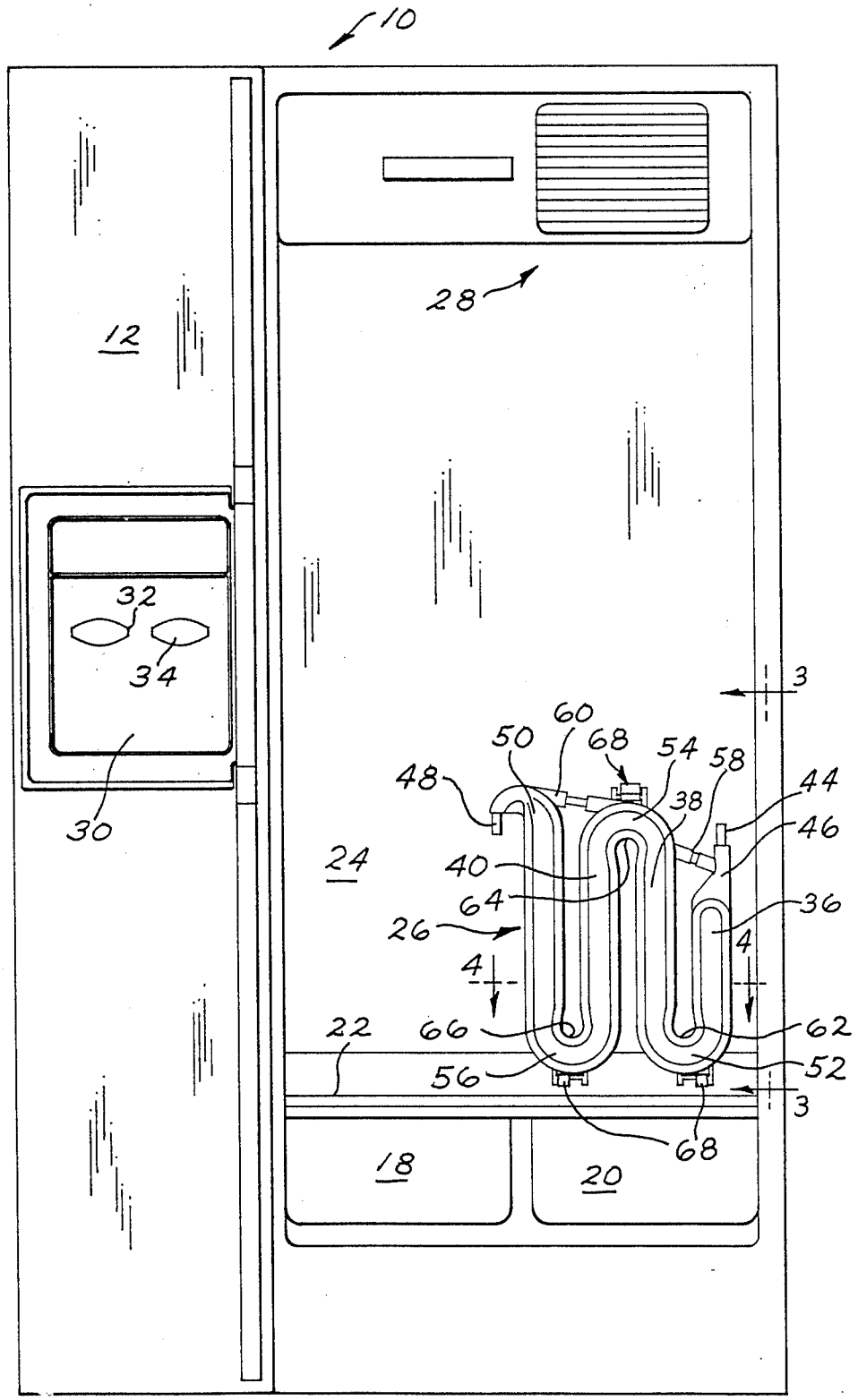
FIG. 2 is a side elevational view of a side-by-side refrigerator with the fresh food compartment door removed to show the present invention incorporated therein.

With reference to FIGS. 1 and 2, there is shown a refrigerator 10 of the side-by-side type wherein there is a freezer compartment on the left hand side closed by a freezer door 12 and a fresh food compartment 14 shown in the figures with the fresh food access door and shelves removed. At the bottom of the fresh food compartment 14 is a meat/vegetable pan assembly 16 including two side-by-side pans 18 and 20 which are covered by a cover 22. Usually there is another vegetable pan above the assembly 16 that extends the width of the fresh food compartment that would be located in front of the water storage tank 26 of the present invention which is secured to the rear wall 24 of the compartment. That pan has been omitted in order to see the water storage tank 26. Located at the top of the fresh food compartment is a cold air control assembly which the user adjusts to regulate the amount of cold air being introduced from the freezer compartment into the fresh food compartment to keep it at the desired temperature.

The household refrigerator shown in the preferred embodiment is of the side-by-side type and has in the outside of the freezer door 12 a dispensing compartment 30 wherein the user may obtain ice cubes or cold water depending upon the selection by pressing one or the other of the actuators 32 or 34. Not shown is a tube connecting the water storage tank 26 to the outlet for dispensing the cold water into a glass held by the user in the dispensing compartment 30.

In refrigerators such as the one shown in the preferred embodiment it is normal for cold air which is heavier than warm air to flow downwardly in the fresh food compartment and has a tendency to stay in the lower part of the compartment because it is heavier than warm air. The result is that cold air which may be slightly lower than water freezing temperature comes in contact with water storage tank and can cause the water contained therein to freeze with a result that the storage tank is ruptured.

Figure 6:
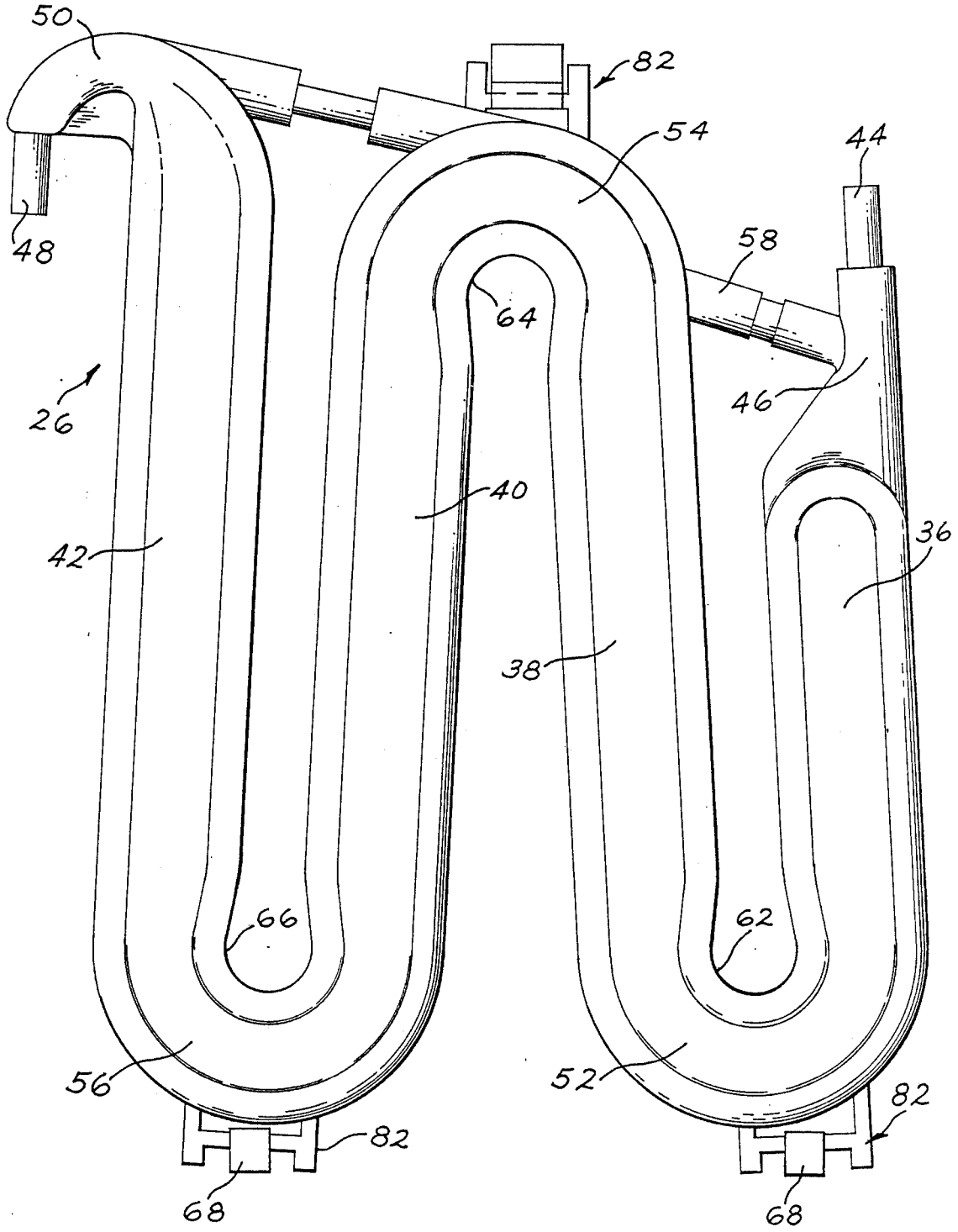
FIG. 6 is a side elevational view of the water storage tank of the present invention showing the configuration of the tank in the event water contained therein is frozen.

With particular reference to FIGS. 1, 2 and 6, the water storage tank 26 comprises a serpentine shaped hollow body having a first straight section 36, a second straight section 38, a third straight section 40, and a fourth straight section 42. These sections are essentially parallel to each other as shown in FIG. 2 and the first section 36 has an inlet 44 at the top end 46 and the fourth section 42 has an outlet 48 at the top end 50. The first section 36 is connected to the second section by a U-shaped curved section 52 at the bottom end, the second section 38 and third section 40 are connected at the top by a U-shaped curved section 54, and the third section 40 and fourth section 42 are connected at the bottom by a U-shaped curved section 56. The four straight sections 36, 38, 40 and 42 are connected at the top thereof by air flow passageways and as shown in the figures the first passageway extends from the top 46 of the straight section 36 to the top U-shaped curved section 54 and is designated as passageway 58. Between the top U-shaped curved portion 54 and the top end 50 of straight section 42 there is air passageway 60. These passageways are provided in order to bleed off any air trapped in the water storage tank so that the water in the tank may be dispensed in a desirable fashion. It will be noted that the four straight sections 36, 38, 40 and 42 are only connected by the three U-shaped curved sections 52, 54 and 56 and the air flow passageways 58 and 60.

The water storage tank 26 of the preferred embodiment is molded from polyethylene plastic material and in molding the storage tank the U-shaped curved sections 52, 54 and 56 have the internal curvature area 62, 64 and 66 respectively in the shape of a teardrop which can readily been seen having a wider radius in each of the internal curvature areas 62, 64 and 66 relative to a straight sided reverse curvature. It has been found that with this teardrop shape increased surface area is provided in the curved sections so that in the event water in the tank freezes the material forming the internal curvature areas 62, 64 and 66 will stretch sufficient to prevent rupture of the walls of the water storage tank 26. Moreover, as shown in FIG. 6 the second straight section 38 and the third straight section 40 may separate or diverge from each other in a direction away from the top U-shaped curved section 54 and thus again relieve the force exerted on the water tank by the frozen water contained therein.

Figure 4:
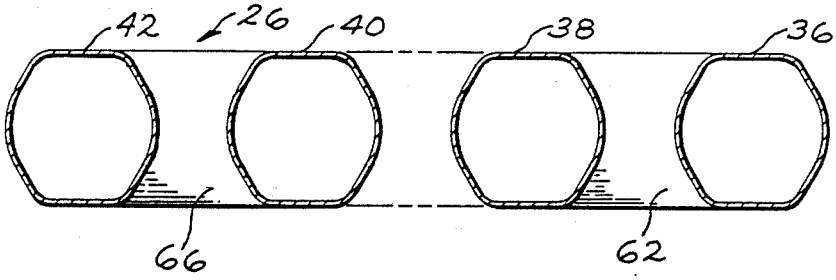
FIG. 4 is a cross-sectional view taken along lines 41'4 of FIG. 2 showing a portion of the present invention.
Figure 5:
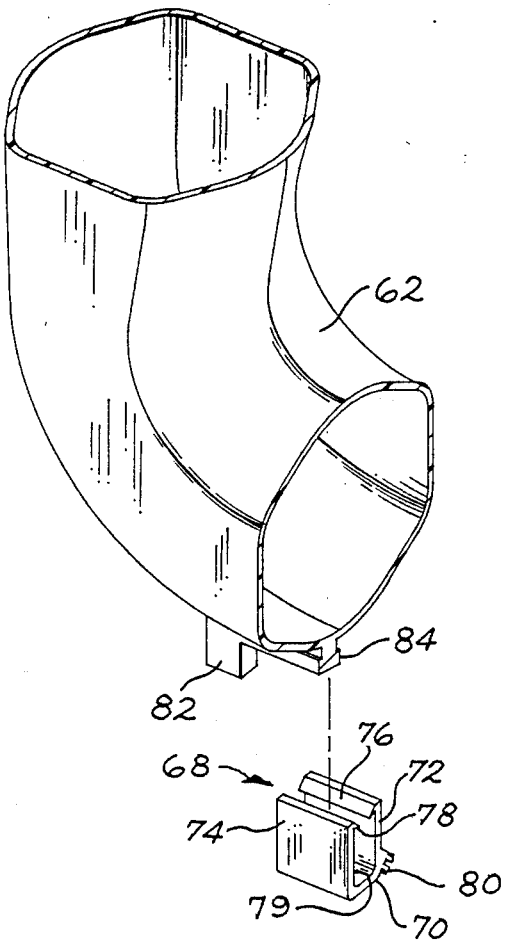
FIG. 5 is an enlarged perspective view of a portion of the water storage tank of the present invention.

As shown particularly in FIGS. 4 and 5, the lateral cross-sections of the straight sections 36, 38, 40 and 42 are polygon in shape and in the preferred erbodiment the polygon is a hexagon. With this lateral cross-sectional polygon shape there is provided a plurality of relatively straight sides so that when the water in the tank 26 freezes the relatively straight sides will bow outwardly and approach a circle configuration as viewed in lateral cross-section, again relieving the internal stress caused by the frozen water to prevent rupture of the water storage tank.

Figure 3:
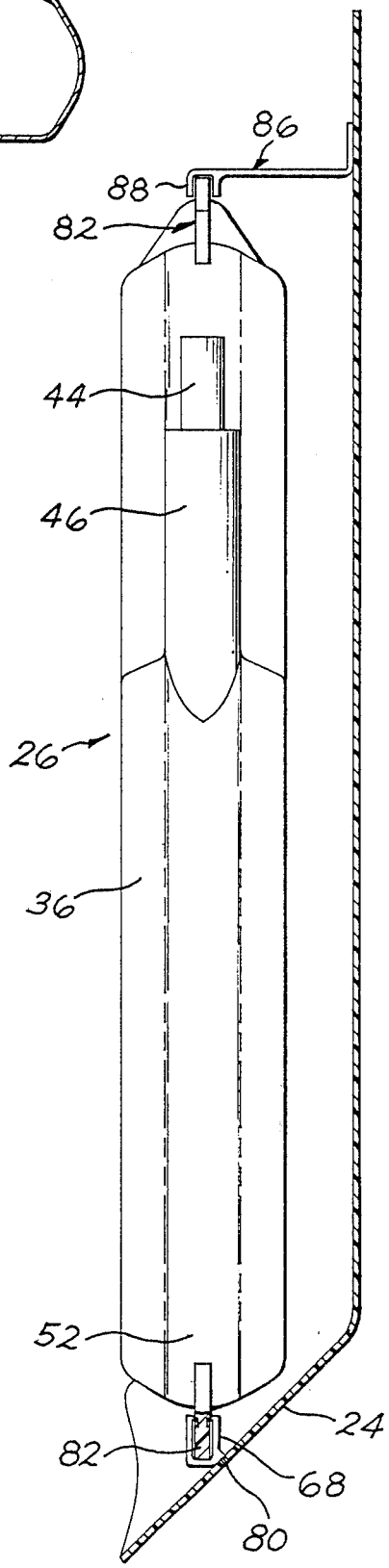
FIG. 3 is an enlarged view taken along lines 3—3 of FIG. 2 showing the present invention.

The water storage tank 26 in the preferred embodiment is secured to the rear wall 24 of the fresh food compartment 14 and for this purpose there is provided storage tank support means 68 which may be in the form of a U-shaped channel having a base 70 and two spaced apart legs 72 and 74 which legs terminate with an inwardly directed fange 76 and 78 respectively. The legs and base form an open ended channel 79 and at the junction of the base 70 and the legs 72 is a projection 80 which as seen in FIG. 3 is inserted in an opening in the back wall 24 to support the storage tank support means 68. The water storage tank 26 has at least one securing member 82 located at the bottom of at least one U-shaped curved section such as section 52, which securing meaber 82 cooperates with the support means 68 to allow relative movement therebetween and to secure the water storage tank to the fresh food compartment. In the case of the preferred embodiment the securing member 82 is molded in the water storage tank and has a T-shaped cross-section member 84 which slides into the channel 79 of the storage tank support means 68. As can be seen, the T-shaped member 84 can move back and forth in the storage tank support means 68 thereby providing relative movement between the T-shaped member 84 and the support means 68. In the preferred embodiment there are two of these assemblies at the bottom of the water storage tank 26, one located at the bottom of the U-shaped curved section 52 and another at the bottom of the U-shaped curved section 56. The top of the water storage tank 26 is also secured to the rear wall 24 of the fresh food compartment by means of a clip 86 having one end fastened by suitable means to the rear wall 24 and the opposite end having a U-shaped portion 88 which receives therein the upper securing member 82 so that the securing member 82 cooperates with the U-shaped section 88 to prevent movement of the water storage tank relative to the rear wall 24. The securing member 82 at the top of the water tank is also molded along with the water tank and is formed in the U-shaped curved section 54. It will be noted that the water storage tank 26 may have two sections, one made up of straight sections 36 and 38 and one made up of straight sections 40 and 42. With this structural arrangement the two sections may be physically moved away from each other at the bottom thereof. This spread apart position is shown in FIG. 6. In the event water in the water storage tank 26 freezes, these two sections can spread apart at the bottom to help relieve the internal stresses caused by the frozen water and also help to prevent rupture of the storage tank. This aoveaent of the two sections is permitted because of the relative movement allowed by the cooperative arrangement between the securing member 82 and the storage tank support means 68 at the bottom of the storage tank.

The foregoing is a description of the preferred embodiment of the invention and it should be understood that variations may be made thereto without departing from the true spirit of the invention as defined in the appended claims.

What is claimed is:

1. A water storage tank for use in the fresh food compartment of a refrigerator comprising:

a serpentine shaped hollow body having parallel first, second, third, and fourth straight sections serially connected and having their lateral cross-sections polygon in shape, said first section having an inlet at the top end and the fourth section having an outlet at the top end, said first sections connected to the second section by a U-shaped curved section at the bottom end, said second and third sections connected at the top by a U-shaped curved section, said third and fourth sections connected at the bottom by a U-shaped curved section, the four straight sections connected at the top thereof by air flow passagways and said U-shaped curved sections having an internal curvature in the shape of a teardrop.

2. The water storage tank of claim 1 wherein the polygon is a hexagon.

3. The water storage tank of claim 1 wherein the refrigerator has water storage tank support means in the frest food compartment and the water storage tank has at least one securing member located at the bottom of at least one U-shaped curved section that cooperate with the support means to allow relative movement therebetween and to secure the water storage tank to the fresh food compartment.

4. The water storage tank of claim 3 wherein there is a securing member at the bottom of the U-shaped curved sections connecting the first straight section to the second straight section at the bottom thereof and a securing member at the bottom of the U-shaped curved section connecting the third straight section to the fourth straight section.

5. The water storage tank of claim 4 wherein there is a third securing member at the top of the U-shaped curved section connecting the second straight section to the third straight section at the top thereof.

* * * * *